US005183951A

United States Patent [19]

Bilodeau

[11] Patent Number: 5,183,951

[45] Date of Patent: Feb. 2, 1993

[54] WEAPONRY SIGNAL APPARATUS

[76] Inventor: Richard R. Bilodeau, 227 Bean Hill Rd., Laconia, N.H. 03246

[21] Appl. No.: 765,874

[22] Filed: Sep. 26, 1991

[51] Int. Cl.[5] ..... F41A 17/08

[52] U.S. Cl. ..... 42/1.01; 42/106; 124/1

[58] Field of Search ..... 42/106, 1.01; 340/539, 340/573; 116/4, 202; 124/1; 342/458

[56] References Cited

U.S. PATENT DOCUMENTS

| | | | |
|---|---|---|---|
| H538 | 11/1988 | Betzold | 89/41.18 |
| 2,472,136 | 6/1949 | Whitlock | 89/41.18 |
| 3,366,958 | 1/1968 | Seaborn | 342/458 |
| 3,400,398 | 9/1968 | Ash | 42/106 |
| 4,008,478 | 2/1977 | Ikrath et al. | 343/720 |
| 4,563,827 | 1/1986 | Heltzel | 42/70.01 |
| 4,598,272 | 7/1986 | Cox | 340/539 |
| 4,833,452 | 5/1989 | Currier | 340/539 |
| 4,936,037 | 6/1990 | Holcomb et al. | 42/106 |
| 5,044,107 | 9/1991 | Holford | 42/106 |

*Primary Examiner*—Michael J. Carone
*Attorney, Agent, or Firm*—Leon Gilden

[57] ABSTRACT

An apparatus is arranged for securement to an associated hunting weapon, such as a bow or rifle, to include a receiver and transmitter operative with other such units, whereupon reception of a transmitted signal effects blinking or illumination of a light member to indicate positioning of another hunter in an adjacent environment to warn opposing hunters of each other's presence. Further, a modification of the invention includes the housing removably mounted relative to an associated rifle, including a further housing in association therewith, with the further housing including various signal structure to enhance an ability of an individual to alert other hunters of orientation and positioning of a hunter utilizing the apparatus.

4 Claims, 5 Drawing Sheets

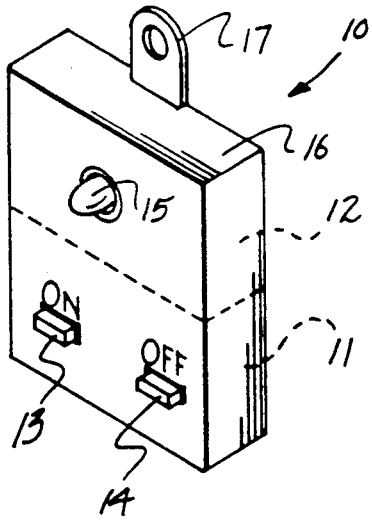
Fig 1
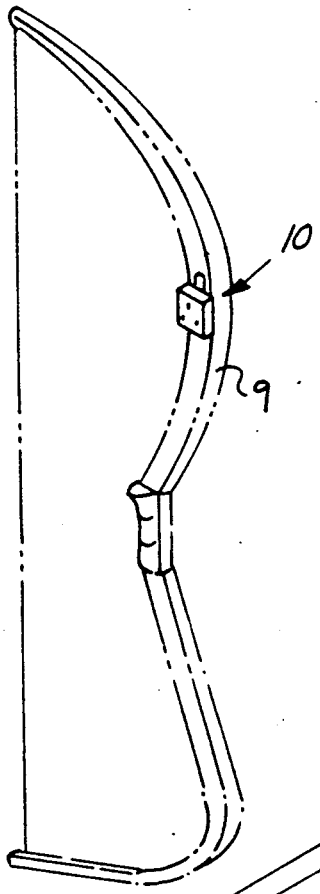
Fig 2
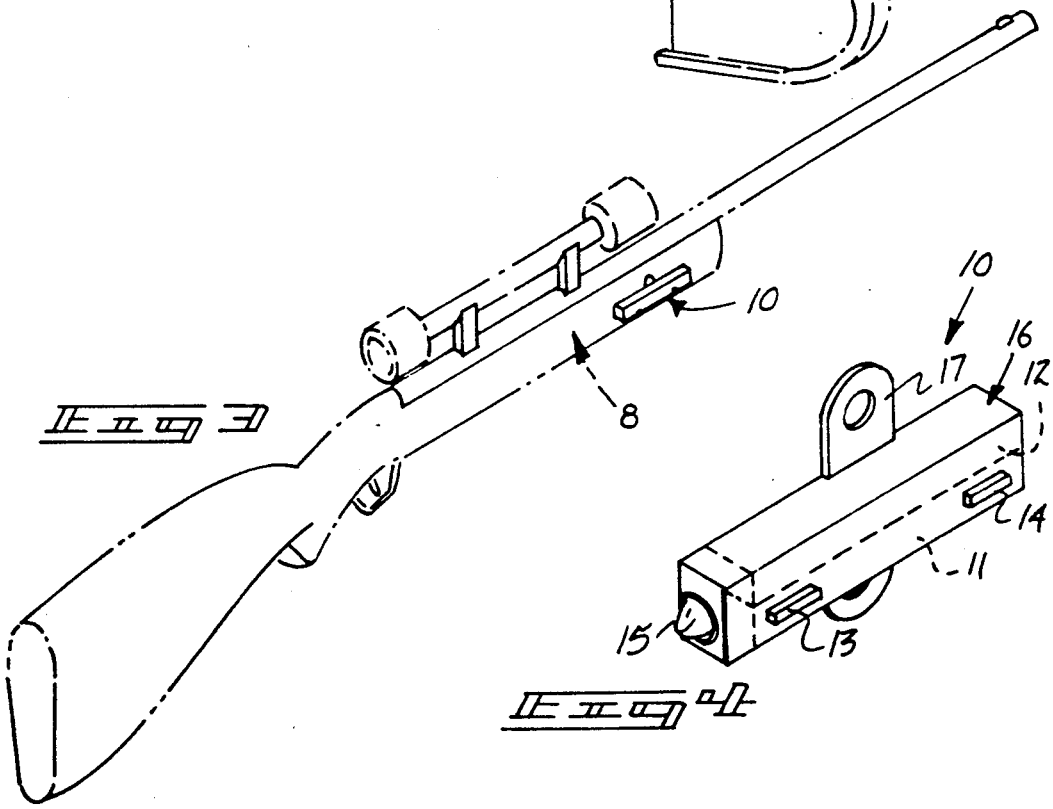
Fig 3
Fig 4

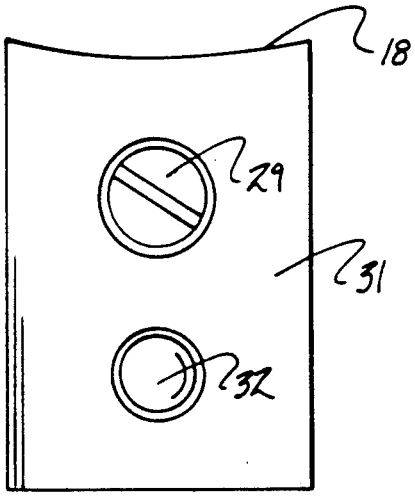
FIG 7
FIG 9
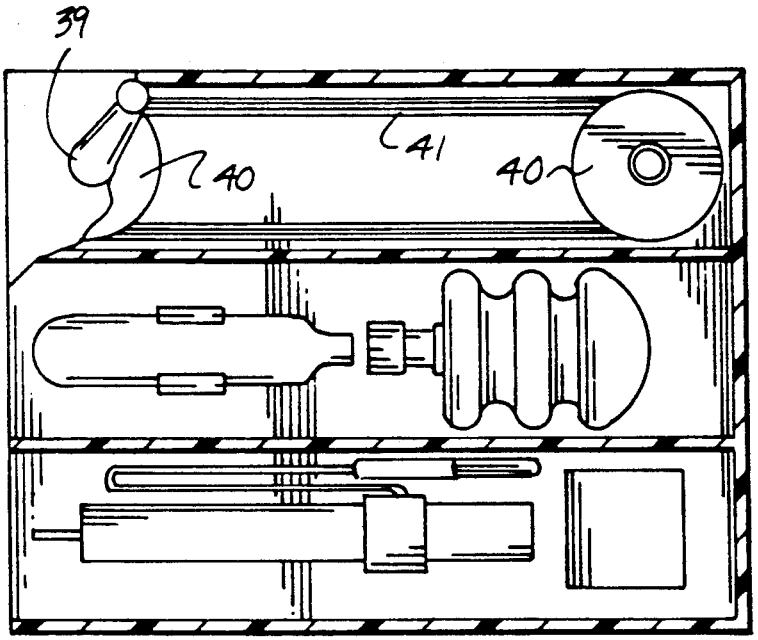

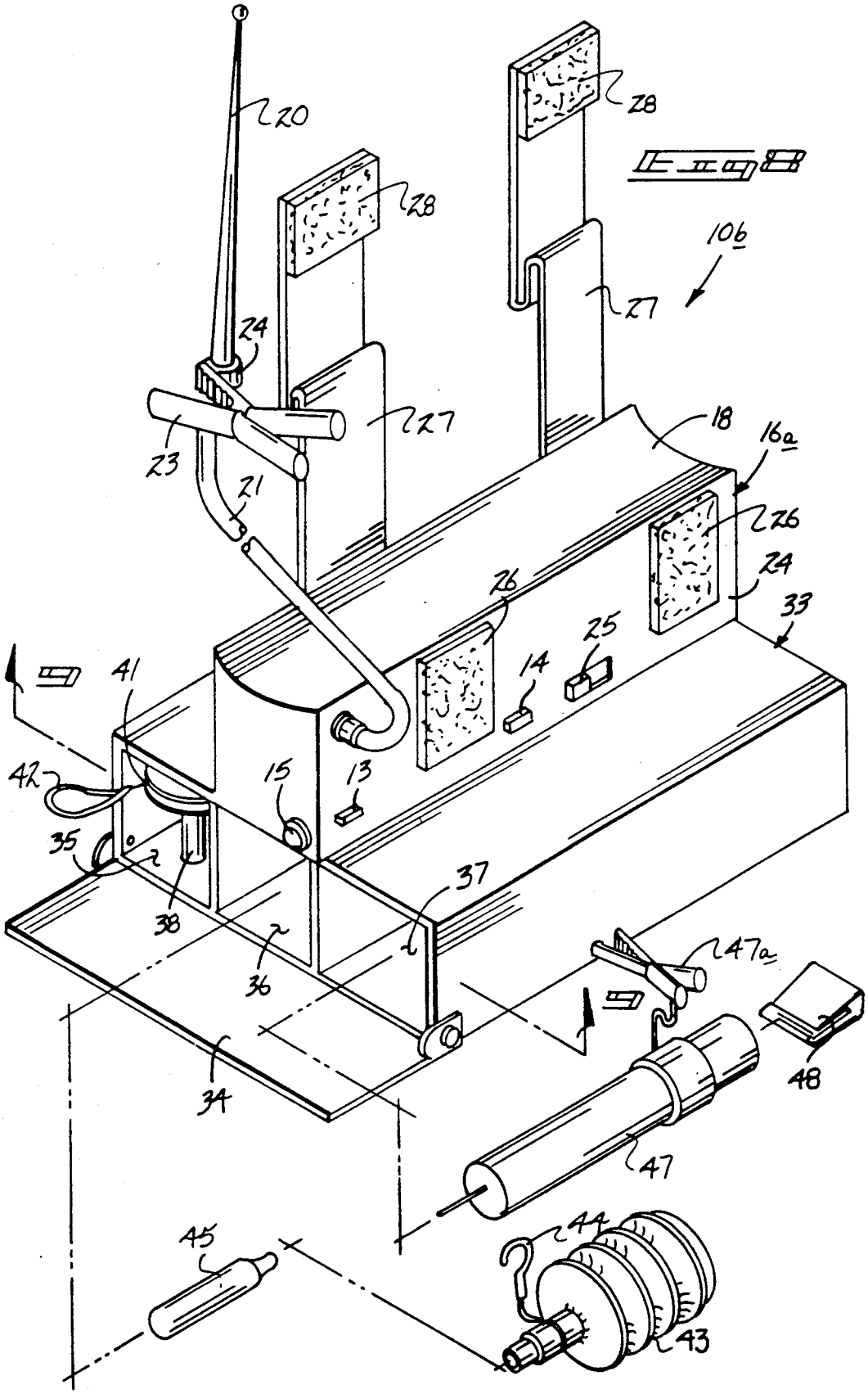
20
28
28
10b
27
24
27
18
16a
23
21
26
24
26
33
25
14
41
42
15
13
35
38
37
36
47a
34
48
47
45
44
43

WEAPONRY SIGNAL APPARATUS

BACKGROUND OF THE INVENTION

1. Field of the Invention

The field of invention relates to signal apparatus, and more particularly pertains to a new and improved weaponry signal apparatus arranged to provide signalling and alerting of other hunters of the presence of other individuals engaged in the sport.

2. Description of the Prior Art

Various firearm safety apparatus is utilized in the prior art to ensure safety in association with firearms. Annually, hunting deaths and injuries are resultant due to lack of knowledge of opposing hunters of the presence of such opposing hunters. Firearm safety apparatus in the prior art, however, has failed to completely meet this need wherein U.S. Pat. No. 4,476,644 to Laing for example utilizes a firearm safety apparatus to provide an audible alarm when the safety is in an off position and the weapon is ready to fire.

U.S. Pat. No. 4,719,713 to Hagle sets forth a trigger safety apparatus utilizing a signalling structure to include energizable audio and visual signals mounted to a component of the trigger.

U.S. Pat. No. 4,829,692 to Guild and 4,739,569 to Battle set forth further firearm safety devices utilizing signalling structure to alert an operator of the safety of an individual firearm.

As such, it may be appreciated that there continues to be a need for a new and improved weaponry signal apparatus as set forth by the instant invention which addresses both the problems of ease of use as well as effectiveness in construction in providing signalling of opposing individuals of the presence of the individual hunter and in this respect, the present invention substantially fulfills this need.

SUMMARY OF THE INVENTION

In view of the foregoing disadvantages inherent in the known types of firearm safety apparatus now present in the prior art, the present invention provides a weaponry signal apparatus wherein the same is arranged to alert hunters of the presence of opposing hunters. As such, the general purpose of the present invention, which will be described subsequently in greater detail, is to provide a new and improved weaponry signal apparatus which has all the advantages of the prior art firearm safety apparatus and none of the disadvantages.

To attain this, the present invention provides an apparatus arranged for securement to an associated hunting weapon, such as a bow or rifle, to include a receiver and transmitter operative with other such units, whereupon reception of a transmitted signal effects blinking or illumination of a light member to indicate positioning of another hunter in an adjacent environment to warn opposing hunters of each other's presence. Further, a modification of the invention includes the housing removably mounted relative to an associated rifle, including a further housing in association therewith, with the further housing including various signal structure to enhance an ability of an individual to alert other hunters of orientation and positioning of a hunter utilizing the apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weaponry signal apparatus which has all the advantages of the prior art firearm safety apparatus and none of the disadvantages.

It is another object of the present invention to provide a new and improved weaponry signal apparatus which may be easily and efficiently manufactured and marketed.

It is a further object of the present invention to provide a new and improved weaponry signal apparatus which is of a durable and reliable construction.

An even further object of the present invention is to provide a new and improved weaponry signal apparatus which is susceptible of a low cost of manufacture with regard to both materials and labor, and which accordingly is then susceptible of low prices of sale to the consuming public, thereby making such weaponry signal apparatus economically available to the buying public.

Still yet another object of the present invention is to provide a new and improved weaponry signal apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a housing unit utilized by the instant invention for securement to an associated bow for firearm.

FIG. 2 is an isometric illustration illustrating the unit housing of FIG. 1 mounted to an associated bow.

FIG. 3 is an isometric illustration of a unit structure mounted to an associated firearm.

FIG. 4 is an isometric illustration of an elongated mounting unit for securement to an associated firearm, as illustrated in FIG. 3.

FIG. 7 is an orthographic view, taken along the lines 7—7 of FIG. 6 in the direction indicated by the arrows.

FIG. 8 is an enlarged isometric illustration of a modified housing unit utilized by the invention.

FIG. 9 is an orthographic view taken along the lines 9—9 of FIG. 8 in the direction indicated by arrows.

DESCRIPTION OF THE PREFERRED EMBODIMENT

Figure 5:
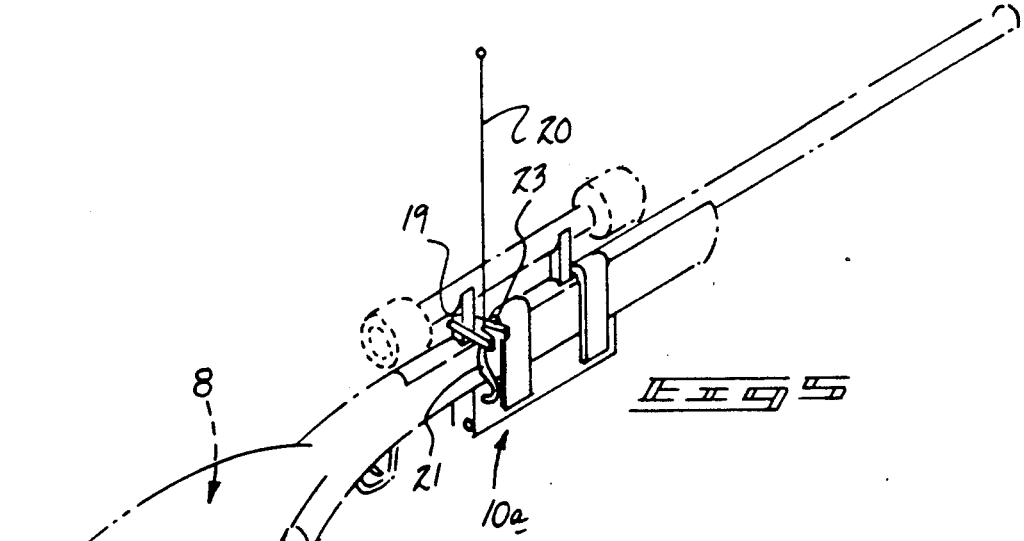
FIG. 5 is an isometric illustration of a modified housing unit utilized by the instant invention.

With reference now to the drawings, and in particular to FIGS. 1-10 thereof, a new and improved weaponry signal apparatus embodying the principles and concepts of the present invention and generally designated by the reference numeral 10 will be described.

More specifically, the weaponry signal apparatus 10 of the instant invention essentially comprises a unitary housing 16 to include a flange 17, wherein the flange 17 permits mounting of the housing to an associated bow, as illustrated in FIG. 2, or a firearm, as illustrated in FIG. 3, wherein an elongated housing of a generally rectangular parallelepiped configuration is utilized in the construction of FIG. 4. The housing 16 includes a transmitter 11 and a receive 12 of conventional circuitry operative through a respective on switch 13 and an off switch 14, wherein a visual indicator light member 15 is illuminated upon reception of a transmitted signal from a remote unit to permit indication of another unit and associated hunter in the vicinity of a first hunter utilizing the unit secured to a weapon, as illustrated in FIGS. 2 and 3.

Figure 6:
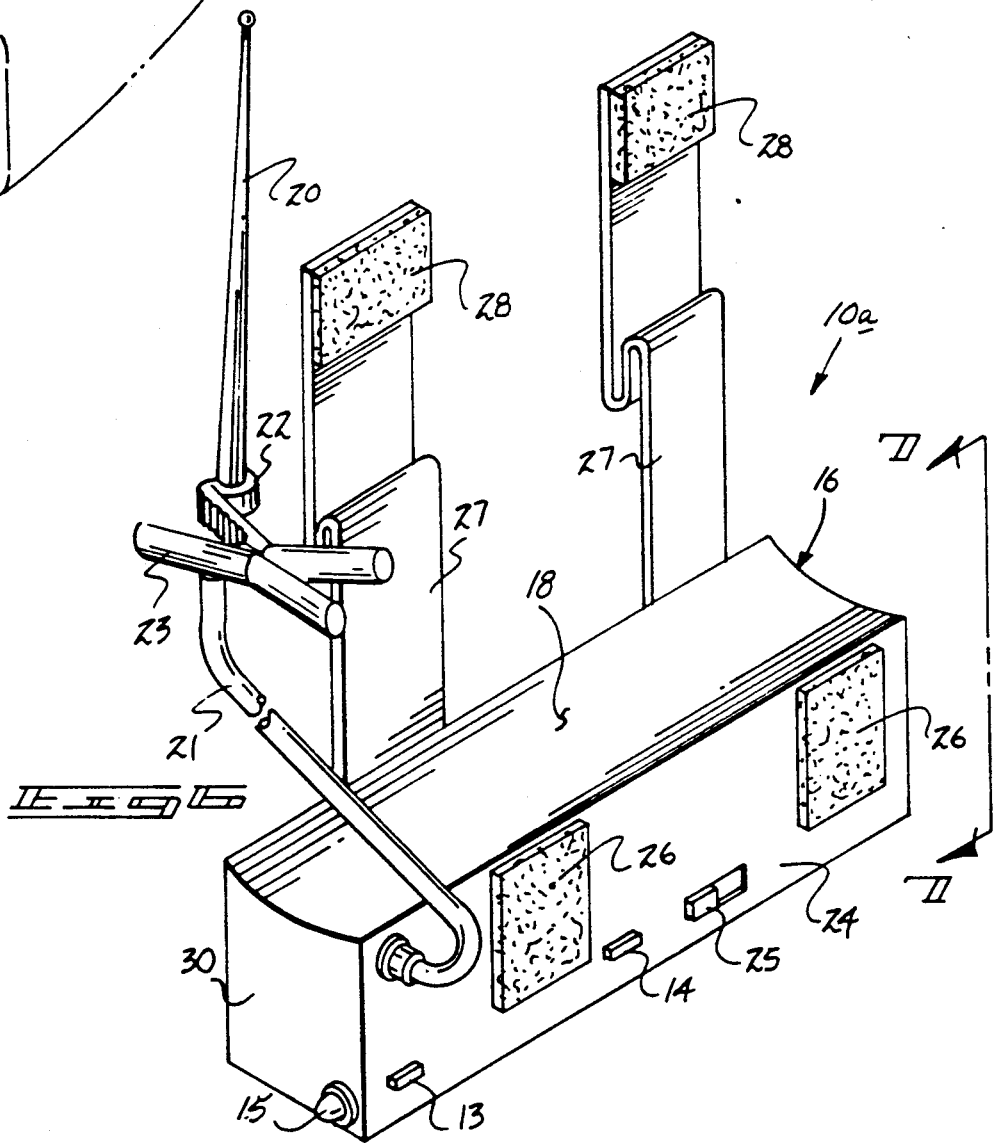
FIG. 6 is an isometric enlarged illustration of the modified housing unit, as illustrated in FIG. 5.

The modified apparatus 10*a*, as illustrated in FIGS. 5 and 6 for example, utilize the elongate housing 16 to include an arcuate housing top wall 18 for enhanced securement of a typical arcuate bottom surface and associated gun member 8, as illustrated in FIG. 5. Typical outfitting of conventional hunting weapons utilizes a telescopic site mounted upon a plurality of telescopic mounts 19. A flexible antenna 20 is provided to enhance reception for the receiver portion of the invention to include its mounting to a flexible antenna cable 21 that is in turn directed interiorly of the housing 16. The junction defined by the antenna 20 and the cable 21 includes a collar 22 mounting a clamp 23. The clamp 23 is arranged for securement to one of the aforenoted telescopic mounts 19 to prevent inadvertent loss of the organization and proper orientation of the antenna in use. Further, a housing forward wall 24 includes a flashlight switch 25, wherein a housing second end wall 31 includes a flashlight lens 32 directed therethrough (see FIG. 7). The housing first end wall 30 includes the indicator light member 15, wherein proper positioning of batteries into the housing 16 through a convenient battery storage lid 29 mounted within the housing second end wall 31 permits operation of the flashlight and illumination of the lens 32. A plurality of spaced first hook and loop patches 26 spaced apart a predetermined spacing are mounted on the housing forward wall 24, wherein a plurality of spaced flexible straps 27 spaced apart the predetermined spacing are mounted to the housing rear wall and in turn are mounted about the stock portion of the firearm to enhance its securement to the housing 16.

Figure 10:
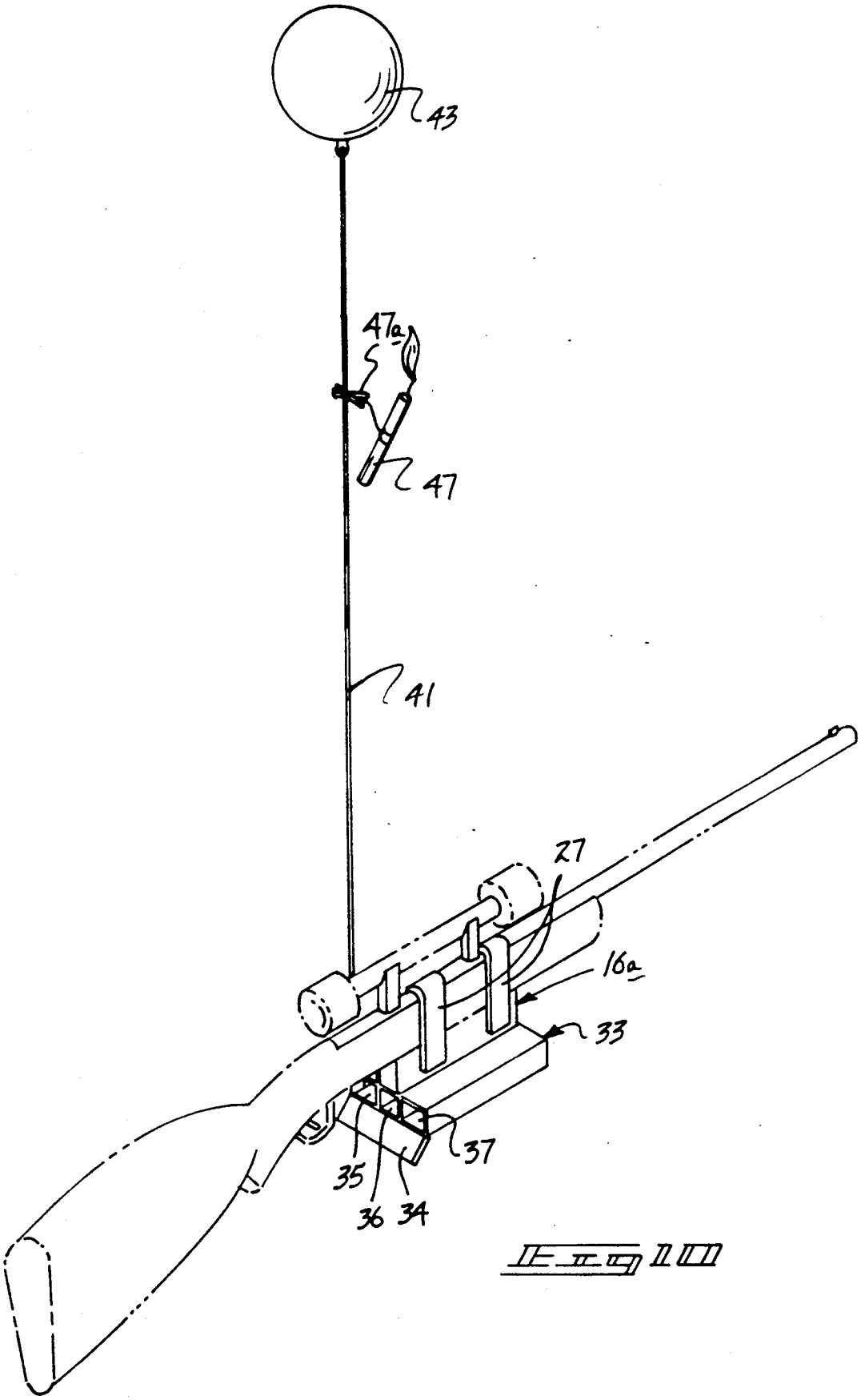
FIG. 10 is an isometric illustration of the further modified housing unit, as illustrated in FIG. 8 in association with an associated firearm.

A further modified organization 10*b*, as illustrated in FIGS. 8-10, illustrates the use of a lower housing 33 fixedly mounted to the housing 16*a* to provide a unitary "T" shaped housing structure. The lower housing includes a pivoted lid 34 directed through a forward wall of the lower housing to provide access to a plurality of compartments defined by elongate parallel first, second, and third compartments 35, 36, and 37. A post 38 is rotatably mounted through a floor of the lower housing 33 positioned within the first compartment 35, with the post 38 fixedly and orthogonally mounting a spool 40 of a plurality of spools, wherein a handle crank 39 fixedly mounted to the post 38 exteriorly of the floor of the lower housing 33 rotatably effects reeling and unreeling of the flexible tether line 41 about at least one of the spools 40. The flexible tether line 39 includes a loop 42 formed at a free terminal end thereof for securement to a luminescent balloon 43 contained within the second compartment 36. The luminescent balloon 43 includes a hood 44, wherein the hook 44 is secured to the loop 42 for repetity and ease of association of the balloon relative to the tether line. The balloon 43 is inflated immediately through a compressed gas canister 45 mounted within the second compartment to permit its inflation and ascent. Typically, helium is utilized as a gas contained within the compressed gas canister 45.

The third compartment 37 includes a flare 47, wherein a flare support clamp 47*a* permits securement of the flare to the tether line upon ascent of the balloon, wherein matches 48 are typically positioned within the third compartment 37 for use in initiating operation of the flare 47.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A weaponry signal apparatus for securement to a weapon, wherein the apparatus includes a housing, the housing including a transmitter and receiver, and a housing first end wall spaced from a housing second end wall, and the housing first end wall including an indicator light member means mounted thereon for illumination upon reception of a signal by the receiver from a remote transmitter, and a first switch means for effecting selective actuation of the transmitter and receiver, and the housing including a flange for securement of the housing to the weapon, and the housing including a housing forward wall spaced from a housing rear wall, the housing forward wall mounting the switch means thereon, and the housing forward wall includes a flashlight switch, the flashlight switch operatively associated with a flashlight lens directed through the housing second end wall for selective illumination of the flashlight lens, and the housing forward wall further including a plurality of spaced first hook and loop fastener patches spaced apart a predetermined spacing, and the housing rear wall including a plurality of spaced flexible straps spaced apart the predetermined spacing, each strap of the spaced flexible straps includes a second hook and loop fastener patch operative with one of said first hook and loop fastener patches, and a flexible antenna cable in operative association with the receiver, the flexible antenna cable secured to a flexible antenna at a junction, the junction including a clamp, and the clamp arranged for securement to a telescopic mount of the weapon.

2. An apparatus as set forth in claim 1 wherein the housing includes a further housing mounted to a bottom wall of the housing, the further housing including a pivoted lid directed through a further housing rear end wall, the pivot lid positioned adjacent the housing first end wall and positioned therebelow, and the pivoted lid providing access to a respective first, second, and third compartment, wherein each compartment of the first, second, and third compartments are arranged in a parallel coextensive relationship through the further housing, and the first compartment including a post rotatably mounted to a floor of the further housing, and a handle crank positioned exteriorly of the further housing mounted to the post to effect rotation of the post, and a spool mounted to the post interiorly of the first compartment, and a flexible tether line mounted about the spool, and the spool including a loop mounted at a free end of the spool.

3. An apparatus as set forth in claim 2 wherein the second compartment includes a luminescent balloon, the luminescent balloon includes a hook secured thereto, the hook selectively securable to the loop of the flexible tether line, and a compressed gas canister contained within the second compartment to effect selective inflation of the luminescent balloon.

4. An apparatus as set forth in claim 3, wherein the third compartment includes a luminescent flare, the luminescent flare including a luminescent flare clamp, the luminescent flare clamp securable to the flexible tether line, and at least one match member within the third compartment arranged for selective ignition of the luminescent flare.

* * * * *